US007591051B2

(12) United States Patent
Kusayama et al.

(10) Patent No.: US 7,591,051 B2
(45) Date of Patent: Sep. 22, 2009

(54) WATERPROOF TOP END STOP OF SLIDE FASTENER

(75) Inventors: Masahiro Kusayama, Toyama (JP); Yutaka Tominaga, Toyama (JP); Ryo Tanaka, Toyama (JP)

(73) Assignee: YKK Corporation, Tokyo (JP)

( * ) Notice: Subject to any disclaimer, the term of this patent is extended or adjusted under 35 U.S.C. 154(b) by 243 days.

(21) Appl. No.: 11/529,101

(22) Filed: Sep. 28, 2006

(65) Prior Publication Data

US 2007/0067969 A1 Mar. 29, 2007

(30) Foreign Application Priority Data

Sep. 29, 2005 (JP) ..... 2005-284939

(51) Int. Cl.
*A44B 19/32* (2006.01)

(52) U.S. Cl. ..... 24/387; 24/389

(58) Field of Classification Search ..... None
See application file for complete search history.

(56) References Cited

U.S. PATENT DOCUMENTS

| | | | | |
|---|---|---|---|---|
| 2,800,699 | A * | 7/1957 | Armstrong | 24/387 |
| 2,923,992 | A * | 2/1960 | Armstrong et al. | 24/389 |
| 2,928,156 | A | 3/1960 | Doelter et al. | |
| 4,524,493 | A * | 6/1985 | Inamura | 24/389 |
| 4,825,514 | A * | 5/1989 | Akeno | 24/389 |
| 5,253,395 | A * | 10/1993 | Yano | 24/387 |
| 6,519,826 | B1 * | 2/2003 | Ortlieb | 29/410 |
| 2007/0226965 | A1 * | 10/2007 | Cossutti | 24/389 |

FOREIGN PATENT DOCUMENTS

| | | |
|---|---|---|
| DE | 20 2006 001 891 | 6/2006 |
| EP | 0 095 160 | 11/1983 |
| GB | 834433 | 5/1960 |
| GB | 2 199 616 | 7/1988 |
| JP | 4-36659 | 8/1992 |

* cited by examiner

*Primary Examiner*—Jack W. Lavinder
(74) *Attorney, Agent, or Firm*—Alston & Bird, LLP

(57) ABSTRACT

The invention provides a waterproof top end stop for a slide fastener for enhancing its waterproof and airproof properties, wherein fastener elements are attached to opposing side edges of a pair of waterproof fastener tapes, an elastic top end stop is attached adjacent to the fastener elements and includes an accommodating portion in a center for accommodating a diamond; protrusions projecting in a front/rear surface direction around the accommodating portion and making a pressure contact with inner faces of blades; passage portions at entrances of the top end stop; and pressing portions on outer edges of insertion leg portions of the top end stop corresponding to the passage portions, outer sides of the pressing portions project outward with respect to contact faces of leg portions of an adjacent fastener element, and the pressing portions are pressed by flanges of the slider and the passage portions are closed firmly simultaneously.

5 Claims, 11 Drawing Sheets

WATERPROOF TOP END STOP OF SLIDE FASTENER

BACKGROUND OF THE INVENTION

1. Field of the Invention

The present invention relates to a waterproof top end stop for a slide fastener for use in an opening/closing mouth of wet suit, waterproof trousers, waterproof shoes for use under water, and the like.

2. Description of the Related Art

A conventionally known waterproof top end stop 101 for a slide fastener disclosed by a Japanese Utility Model Application Publication No. 4-36659 and shown in FIG. 11 includes: an accommodation hole 110 capable of accommodating a diamond 121 in a slider 102 provided in its center; passage portions 114 in which the diamond 121 can be inserted and which can be closed firmly, the passage portions 114 leading to the accommodation hole 110; an inner sealing portion 111, 113 having a large thickness capable of surrounding the accommodation hole 110 and the passage portions 114 and a rib-like seal 112 which is projected from a surface of the inner sealing portion 111, 113 throughout the accommodation hole 110 and the passage portions 114, the rib-like seal 112 being entirely formed in a racket-like shape and capable of making a firm contact with inner faces of upper and lower blades 120 of the slider 102.

In the waterproof top end stop 101 for a slide fastener shown in FIG. 11, its inner sealing portion 111, 113 having a large thickness capable of burying an inside of a body of the slider 102 is formed entirely to be long longitudinally. A rib-like seal 112 which makes a contact with upper and lower blades 120 of the slider 102 formed on the inner sealing portion 111, 113 needs to be projected in a form of a racket into both the accommodation hole 110 and the passage portions 114. Accordingly, this structure is not so preferable from view points of waterproof and airproof because the rib-like seal 112 is provided for a long distance. Further, in this top end stop 101 , flanges 122 of the slider 102 are brought into a firm contact with the passage portions 114 including a diamond 121 when the slider 102 is pulled up in order to seal the passage portions 114 formed within the inner sealing portion 111, 113. According to this structure, side faces of the passage portions 114 are just brought into contact with each other by the flanges 122 of the slider 102. Thus, there is such a problem that water may penetrate or invade through the passage portions 114 because side faces of the passage portions 114 are only joined together.

SUMMARY OF THE INVENTION

The present invention has been achieved in view of the above-described problem, and a first object of the invention is to provide a waterproof top end stop for a slide fastener, in which a protrusion which makes contact with an inner face of each of upper and lower blades of a slider, namely, rib-like seal is formed as short as possible to raise waterproof and airproof properties, and pressing portions for positively pressing an outer side face of the top end stop are formed so as to bring contact faces of insertion leg portions, namely, contact portions of a diamond passage portions into a firm contact with each other by forming the contact portions as short as possible, thereby securing waterproof and airproof effects.

In addition to the first object, a second object of the invention is to provide a waterproof top end stop for a slide fastener, in which the pressing portions are provided on outer edge portions of insertion leg portions corresponding to the passage portions to close the passage portions accurately and smoothly, thereby raising waterproof and airproof effects.

In addition to the first object, a third object of the invention is to provide a waterproof top end stop for a slide fastener, in which a relation among the pressing portions installed on the insertion leg portions of the top end stop, the outer edge portions located inside the pressing portions and a slider which accommodates these pressing portions and outer edge portions is specified so as to raise waterproof and airproof effects effectively and accurately.

In addition to the first object, fourth and fifth objects of the invention are to provide a waterproof top end stop for a slide fastener, in which a configuration of the pressing portions which are formed on both outer sides of the insertion leg portions of the top end stop and make contact with flanges of the slider is specified so as to bring the contact portions of the insertion leg portions into an aggressive contact with each other effectively and accurately, thereby raising the waterproof and airproof effects.

In addition to the fourth object, a sixth object of the invention is to provide a waterproof top end stop for a slide fastener, in which the insertion leg portions are brought into a partial contact with the blades of the slider through the protrusion and pressing portions, thereby achieving smooth and light sliding of the slider.

In order to achieve the above-described object, according to a first aspect of the invention, there is provided a waterproof top end stop for a slide fastener having elasticity, which is fixed adjacent to fastener elements provided along opposing side edges of a pair of fastener tapes in a slide fastener and which is connected to the fastener tapes, wherein an accommodating portion capable of accommodating a diamond of a sliding slider is provided in a center thereof such that the accommodating portion is surrounded by insertion leg portions; protrusions which make contact with upper and lower blades of the slider are provided projectingly along an inner peripheral edge portion 11 provided on an inner edge of the accommodating portion; passage portions which allow the diamond of the slider to pass through is provided at end portions on inner sides of the insertion leg portions; and pressing portions projecting with respect to a contact faces of leg portions in the fastener elements adjacent to the top end stop or a faces making a sliding contact with the slider are provided on both outer sides of the top end stop, namely, outside the insertion leg portions. The pressing portions can be pressed inward when the slider is slid. Due to contact between the pressing portion and the slider, the passage portions are closed firmly.

According to a second aspect of the invention, in addition to the first aspect, there is provided a waterproof top end stop for a slide fastener, wherein the pressing portions installed in the top end stop are formed at positions corresponding to the passage portions which allow the diamond of the slider to pass through, that is, on outer edge portions of the insertion leg portions.

According to a third aspect of the invention, in addition to the first aspect, there is provided a waterproof top end stop for a slide fastener, wherein the pressing portions installed in the top end stop are provided on the outer edge portions on a side of an entrance of the insertion leg portions, and the outer edge portions provided inside of the top end stop from the pressing portions are formed narrower than an interval between right and left flanges of the slider to avoid making contact with the flanges.

According to a fourth aspect of the invention, in addition to the first aspect, there is provided a waterproof top end stop for a slide fastener, wherein the pressing portions installed in the top end stop are formed to project in up and down directions from the insertion leg portions.

According to a fifth aspect of the invention, in addition to the first aspect, there is provided a waterproof top end stop for a slide fastener, wherein the pressing portions installed in the top end stop are formed to project in an outward direction from the insertion leg portions.

According to a sixth aspect of the invention, in addition to the fourth aspect, there is provided a waterproof top end stop for a slide fastener, wherein the protrusions and pressing portions provided on the insertion leg portions of the top end stop project in up and down directions while a portion between the protrusions and pressing portions is recessed.

Advantages of the present invention will be described below.

According to the first aspect of the invention, even when the passage portions which allow the diamond of the slider to pass through are formed with short small contact faces, the pressing portions provided on both outer sides of the top end stop press the insertion leg portions inward aggressively so as to block water from penetrating or invading. Further, even if the protrusions making contact with the inner faces of blades of the slider is formed in a short length along the inner peripheral edge portion of the accommodating portion, waterproof and airproof properties can be exerted effectively, and moreover, the top end stop can be formed easily.

According to the second aspect of the invention, the passage portions provided inside the insertion leg portions is pressed and closed accurately to block penetration and invasion of water through the passage portions, thereby enhancing waterproof and airproof properties.

According to the third aspect of the invention, the pressing portions provided on the side of an entrance of the insertion leg portions are pressed inward by a sliding operation while inside portions, that is, deep sides relative to the pressing portions do not make contact with the flanges. Consequently, the sliding operation of the slider can be carried out lightly.

According to the fourth and fifth aspects of the invention, the pressing portions provided on the insertion leg portions can be brought into a sliding contact with the flanges of the slider securely, so that the passage portions provided inside the insertion leg portions can be pressed and closed securely. Consequently, extremely favorable waterproof and airproof effects are achieved.

According to the sixth aspect of the invention, the insertion leg portions make a partial contact with the inner faces of the upper and lower blades of the slider, so that the slider can be slid smoothly and lightly. Therefore, the advantages realized by the present invention are remarkable.

DESCRIPTION OF THE PREFERRED EMBODIMENTS

Figure 1:
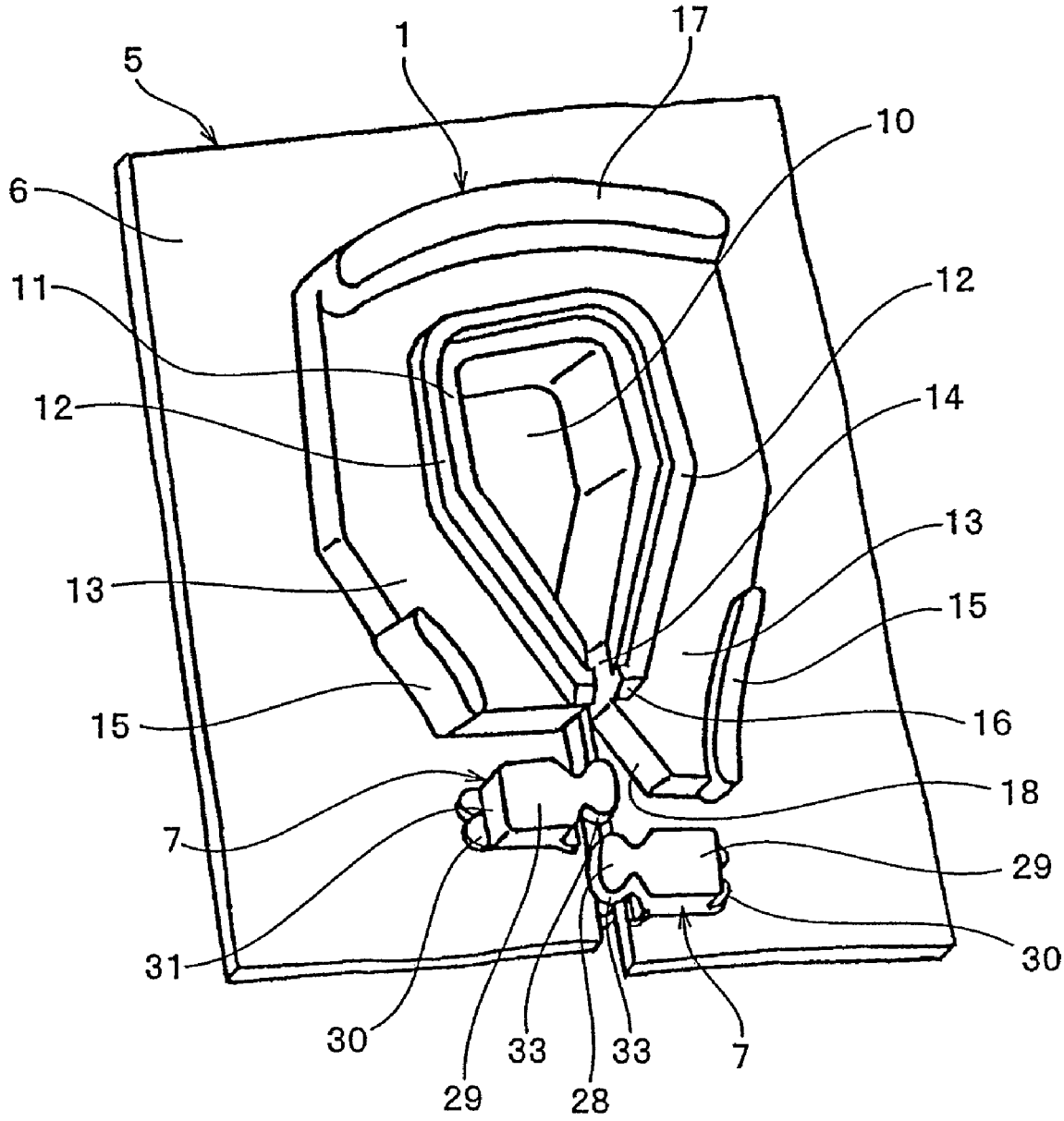
FIG. 1 is a perspective view of a waterproof top end stop for a slider fastener.
Figure 5:
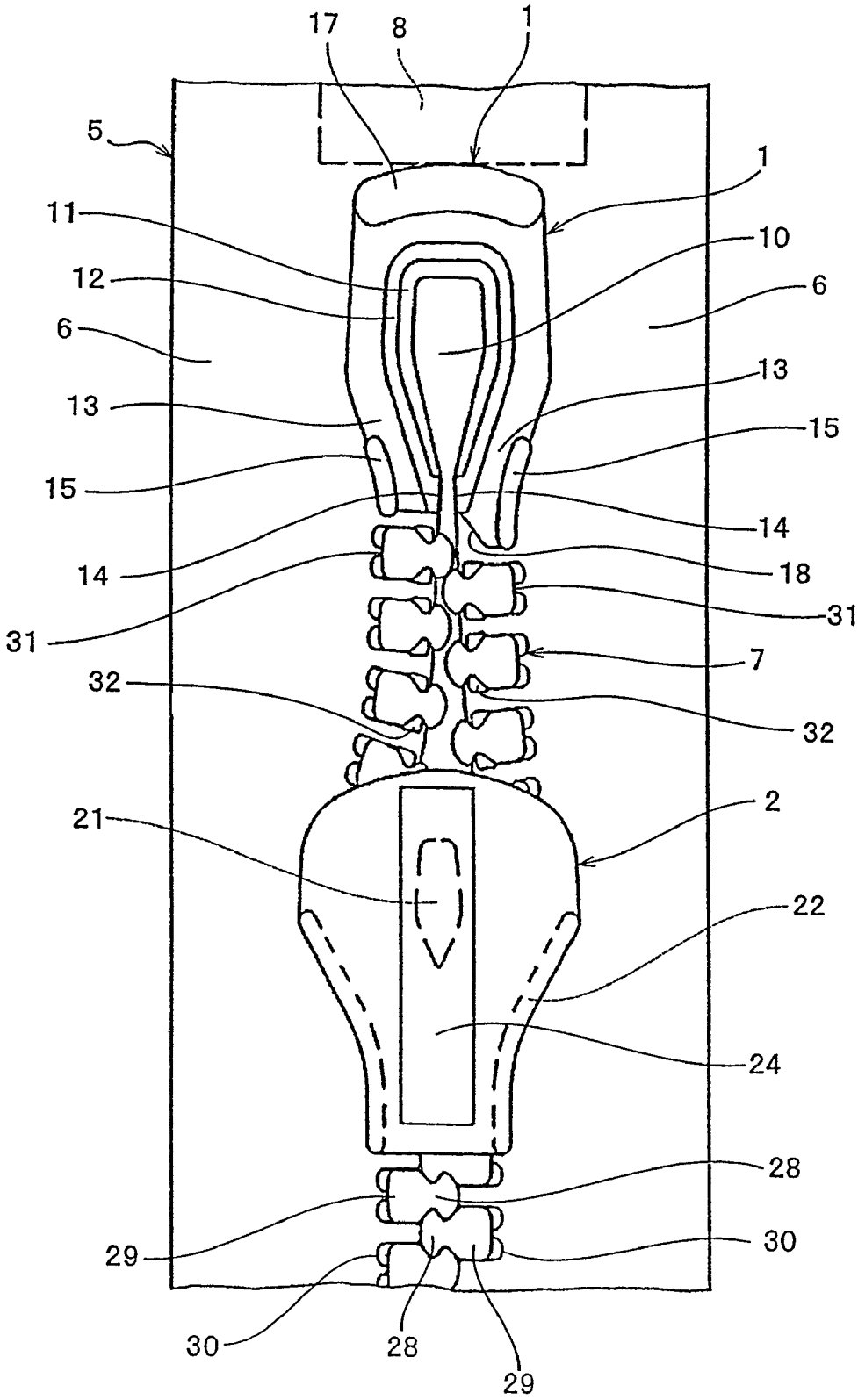
FIG. 5 is a front view showing the use condition of the top end stop.

As regards a waterproof top end stop for a slide fastener of the present invention, as shown in FIGS. 1 and 5, surfaces of a pair of fastener tapes 5 are coated with a waterproof material 6 such as thermoplastic elastomer composed of vinyl chloride or polyethylene or synthetic rubber to form base fabrics 4. Fastener elements 7 composed of thermoplastic resin such as polyamide or polyacetal are formed on side edges of the base fabrics 4 by injection molding. A top end stop 1 is formed at an end portion having the fastener elements 7 attached, the top end stop being composed of the same material as the aforementioned waterproof material 6 and having elasticity in order to stop a slider 2.

The top end stop 1 has one end closed. The top end stop 1 includes an accommodating portion 10 capable of accommodating a diamond 21 of the slider 2 provided in a center thereof, and insertion leg portions 13 formed on right and left sides of the other end such that they are adjacent to the fastener elements 7. Passage portions 14 which allow the diamond 21 of the slider 2 to pass through are formed at sides of entrance end portions of the insertion leg portions 13, namely, on sides of the insertion leg portions 13 adjacent to the fastener elements 7. The passage portions 14 are constructed such that right and left passage portions 14 join together to secure waterproof property when a fastener chain is closed with the slider 2.

Pressing portions 15 are provided by projecting right and left outer sides of the insertion leg portions 13 slightly outward with respect to outside edges of the fastener elements 7, so that the pressing portions 15 are projected in up and down directions while making contact with flanges 22 of the slider 2. Protrusions 12 are provided so as to be projected toward inner faces of upper and lower blades 20 of the slider 2 to make contact therewith along an inner peripheral edge portion 11 of the accommodating portion 10 which accommodates the diamond 21. Entrance end portions of the protrusions 12 face the passage portions 14 of the insertion leg portions 13, and end portions of the protrusions are cut out obliquely to form inclined faces 16, thereby reducing an impact on the upper and lower blades 20 to facilitate passage of the diamond 21 when it is inserted. Stoppers 17 are provided protrudedly on both closed end faces of the top end stop 1 so that head portions 23 of the blades 20 of the slider 2 can make contact with, thereby accommodating the slider 2 accurately in the accommodating portion 10.

In the meantime, back faces of the base fabrics 4 outside the closed stoppers 17 of the top end stop 1 are lined with a seal material 8 to integrate the right and left fastener tapes 5.

Figure 3:
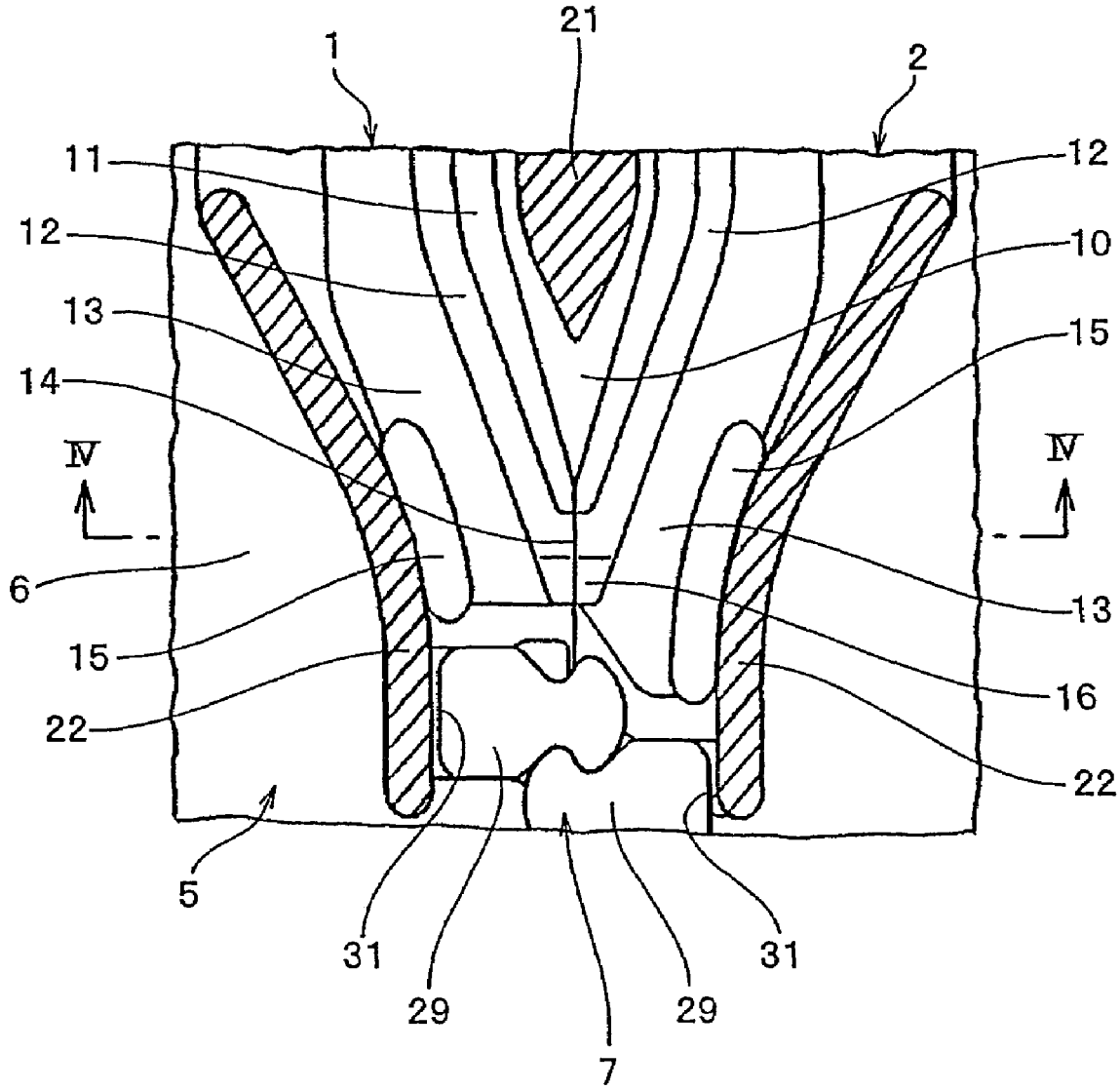
FIG. 3 is an enlarged front view of the top end stop of FIG. 2.
Figure 4:
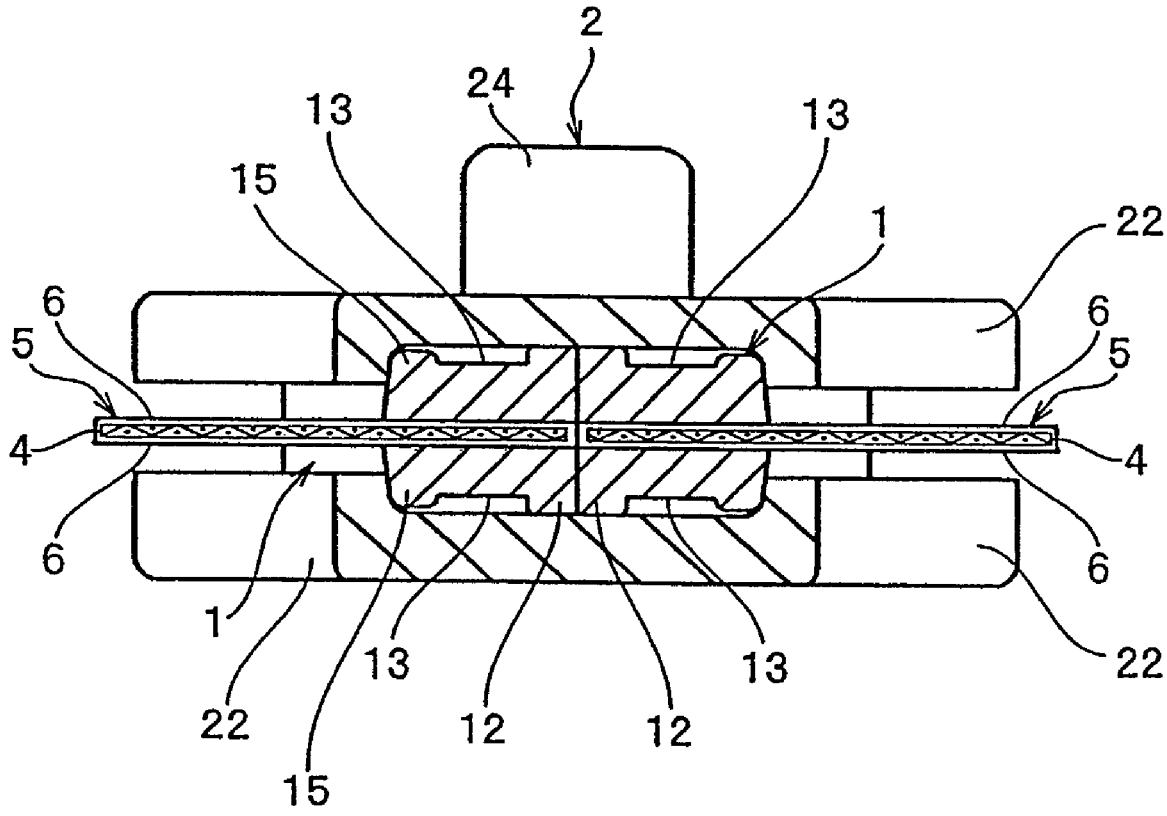
FIG. 4 is a sectional view of the top end stop taken along a line IV-IV in FIG. 3.

As regards a relation between the top end stop 1 and the slider 2, waterproof and airproof properties are exerted in such a manner that the diamond 21 is accommodated in the accommodating portion 10 of the top end stop 1 by sliding the slider 2, so that the top end stop 1 is used as a waterproof top end stop. At this time, when the top end stop 1 accommodates the diamond 21 of the slider 2 in the accommodating portion 10, the protrusions 12 provided along the inner peripheral edge portion 11 of the accommodating portion 10 make a pressure contact with inner faces of the blades 20 as shown in FIG. 4, so that upper and lower faces of the top end stop 1 are closed firmly with inner faces of the slider 2. Regarding a sealing function of the passage portions 14 which allow the diamond 21 to pass through, the passage portion 14 being formed in the insertion leg portions 13 of the top end stop 1, as shown in FIGS. 3 and 4, the pressing portions 15 formed in the right and left insertion leg portions 13 are pressed inward by the flanges 22 so as to bring the passage portions 14 into a firm contact with each other from right and left. Therefore, the waterproof and airproof effects of the top end stop 1 are exerted by bringing the protrusions 12 and the blades 20 into a pressure contact and pressing the pressing portions 15 inward by the flanges 22, so as to seal the passage portions 14.

First Embodiment

In a waterproof top end stop according to a first embodiment shown in FIGS. 1 to 9, front and rear surfaces of a pair of fastener tapes 5 are coated with a waterproof material 6 of thermoplastic elastomer such as vinyl chloride or polyethylene or synthetic rubber so as to form a base fabrics 4. Then, fastener elements 7 are formed on opposing side edges of the base fabrics 4 by injection-molding using thermoplastic resin such as polyamide, polyacetal, polypropylene and polybutylene terephthalate. Each of the fastener elements 7 is formed of mainly a coupling head 28 and a leg portion 29. The leg portion 29 is formed of a square body while a contact face 31 is formed at an outer end of the leg portion 29 such that flanges 22 of a slider 2 makes a sliding contact therewith. Fin portions 30 in a flat shape are provided on the contact face 31 at a side of one of the fastener tapes 5, and the flanges 22 of the slider 2 makes contact with the fin portions 30 and the contact face 31 when the slider slides.

The coupling head 28 is projected from the leg portion 29 in a form of a number 8, and engaging pieces 32 which are in a flat shape and flush with the edge of the fastener tape 5 are provided on the leg portion 29 at a side of the head portion 28 and fitted to a concave groove 33 provided in the coupling head 28 of a mating fastener element. Therefore, the concave groove 33 is formed in a front end of the coupling head 28, so that the engaging pieces 32 projected from both sides of the fastener element 7 of the mating fastener element are accommodated to engage the right and left fastener elements 7 with each other.

The upper and lower blades 20 of the slider 2 are joined with the diamond 21, and the flanges 22 for guiding the fastener elements 7 are provided curvedly on both outer sides of the blades 20. By sliding this slider 2 in back and forth directions, the fastener elements 7 molded on the side edges of the base fabrics 4 are brought into firm contact with each other both in back and forth directions and in right and left directions so as to provide the right and left base fabric 4 with waterproof property.

Figure 2:
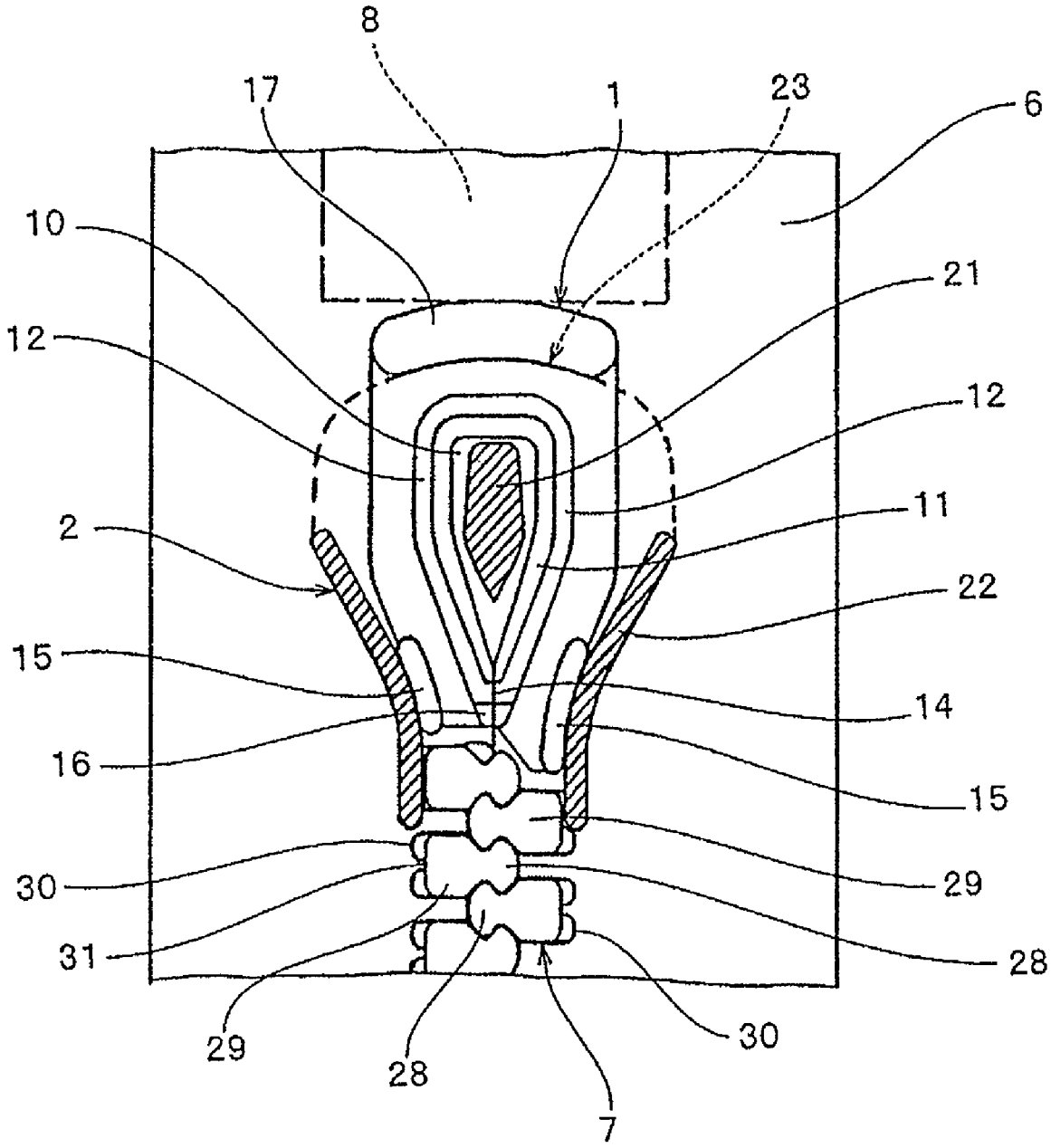
FIG. 2 is a partially broken front view of a slider, showing a use condition of the waterproof top end stop.

A top end stop 1 is injection-molded with the same material as the thermoplastic elastomer such as vinyl chloride or polyethylene or synthetic rubber applied to the surfaces of the base fabrics 4. In the top end stop 1, the accommodating portion 10 capable of accommodating the diamond 21 of the slider 2 is formed in the center with a front end thereof closed such that it is continuous to the fastener elements 7 attached to the side edges of the base fabrics 4, and insertion leg portions 13 are provided integrally on right and left sides of the accommodating portion 10. As shown in FIG. 2, the top end stop 1 further includes the protrusions 12 which is accommodated within the right and left flanges 22 of the slider 2 and provided projectingly toward a surface along the inner peripheral edge portion 11 of the accommodating portion 10 in the center thereof. The protrusions 12 are constructed to make contact with the inner faces of the upper and lower blades 20 of the slider 2 to ensure waterproof performance. Forming of the protrusions 12 along the inner peripheral edge portion 11 means forming of the protrusions 12 at a predetermined distance from the inner peripheral edge portion 11 along a contour of the inner peripheral edge portion 11 or forming of the protrusions 12 on a same plane as the inner peripheral edge portion 11. That is, the protrusions 12 are formed so as to surround the diamond 21 together with the accommodating portion 10.

Entrance end portions of the insertion leg portions 13 of the top end stop 1 can be brought into a firm contact with each other as shown in FIG. 3 to form passage portions 14 which allow the diamond 21 to pass through easily. The protrusions 12 are formed so as to end at the passage portions 14, and the passage portions 14 and the edges of the fastener tapes 5 are formed on an identical plane. Then, inclined faces 16 are formed by cutting portions facing entrances of the protrusions 12, namely, corners of surfaces on a side adjacent to the fastener elements 7 to provide with slopes. A provision of the inclined faces 16 reduces an impact on the upper and lower blades 20, thereby making the diamond 21 to pass through smoothly.

Figure 6:
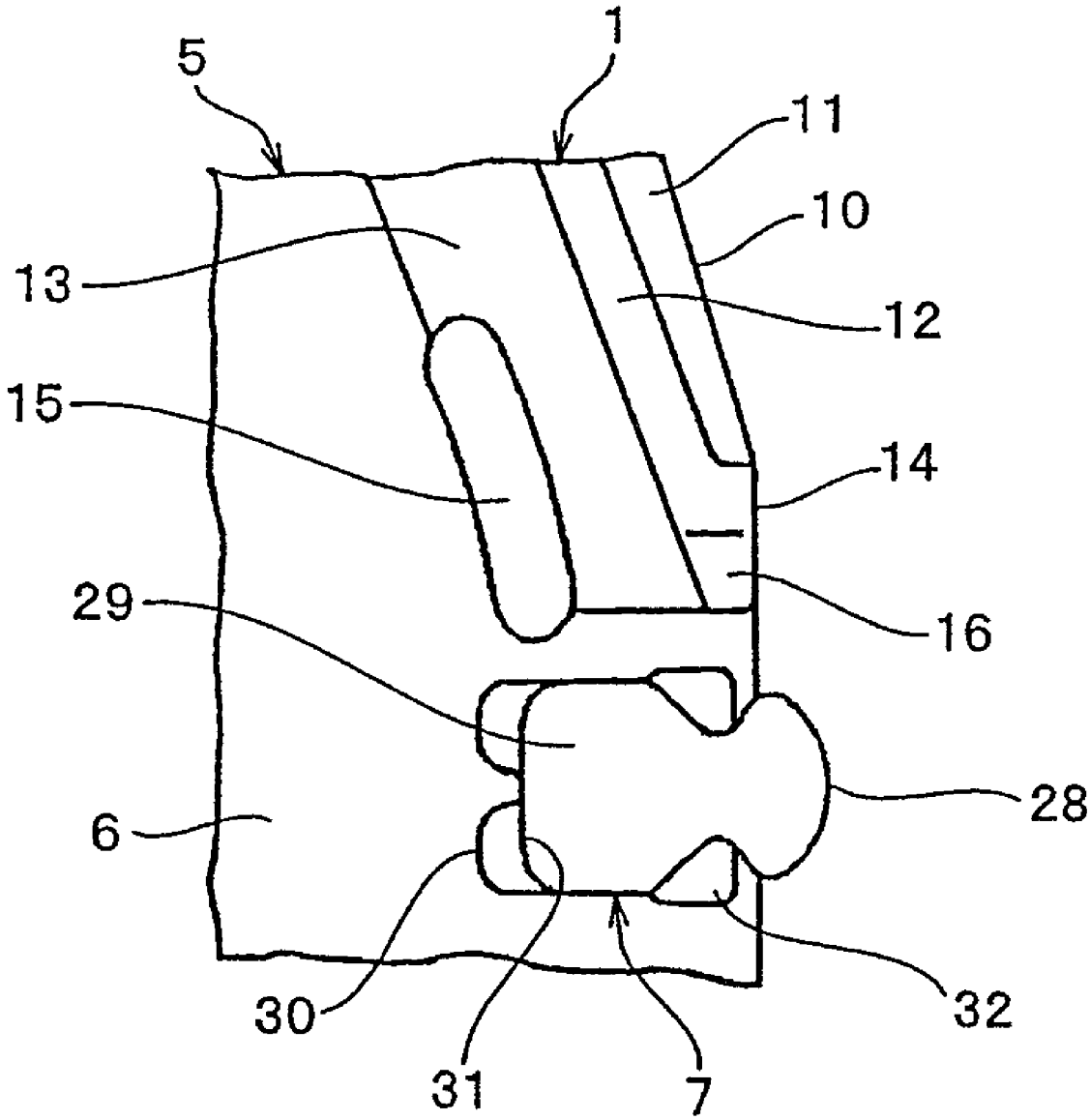
FIG. 6 is an enlarged view of major portions indicating a relation between a pressing portion of the top end stop and a fastener element.

Pressing portions 15 are provided on part of right and left outer sides of the entrance end portions of the insertion leg portions 13 of the top end stop 1 such that the pressing portions 15 are projected outward with respect to outer edges of the insertion leg portions 13 while they are projected toward the blades 20 from upper and bottom surfaces of the insertion leg portions 13. The pressing portions 15 are projected outward with respect to outer side faces, namely, the contact faces 31 of the leg portion 29 in the fastener element 7 molded as shown in FIGS. 3 and 6. When the slider 2 is slid up to a terminal end, there is generated a gap between the flanges 22 of the slider 2 and the contact faces 31 of the leg portion 29. However, no gap exists between the flanges 22 of the slider 2 and the pressing portions 15 molded on the outer side edges of the insertion leg portions 13 of the top end stop 1 so that they make firm contact with each other. Consequently, the pressing portions 15 are pressed inward by the flanges 22, so that the passage portions 14 are closed firmly. If speaking further, a dimension of a width from the outer sides of the pressing portions 15 to the edge portions of the fastener tapes 5 is larger than a dimension of a width from the contact faces 31 of the leg portion 29 to the end portions of the fastener tapes 5. Since the pressing portions 15 project toward the blades 20, contact areas between the pressing portions 15 and flanges 22 can be increased.

On an inner side or deep side relative to the pressing portions 15 formed on the insertion leg portions 13, a width of the top end stop 1 is formed narrower than a gap between the flanges 22 of the slider 2 as shown in FIG. 3 so that the flanges 22 and the insertion leg portions 13 do contact each other in order to slide the slider 2 smoothly. That is, the insertion leg portions 13 not making contact with the flanges 22 are formed inside outside positions of the top end stop 1 corresponding to the passage portions 14 which keep contact, while the pressing portions 15 are formed at least at each position corresponding to the passage portions 14. In other words, the pressing portions 15 are formed at least in a same length as those of the protrusions 12 facing the passage portions 14. Preferably, the pressing portions 15 are formed longer than the protrusions 12 and in a same length as or longer than the passage portions 14. A recession is provided between the protrusions 12 formed around the accommodating portion 10 and the pressing portions 15 in the insertion leg portions 13 of the top end stop 1. Consequently, the slider 2 can slide smoothly and lightly because of a partial contact by the blades 20 of the slider 2. In the meantime, although the right and left end portions at the entrances of the insertion leg portions 13 are shifted to each other corresponding to an arrangement of the fastener elements 7, right and left end portions of the protrusions 12 meet each other.

Figure 9:
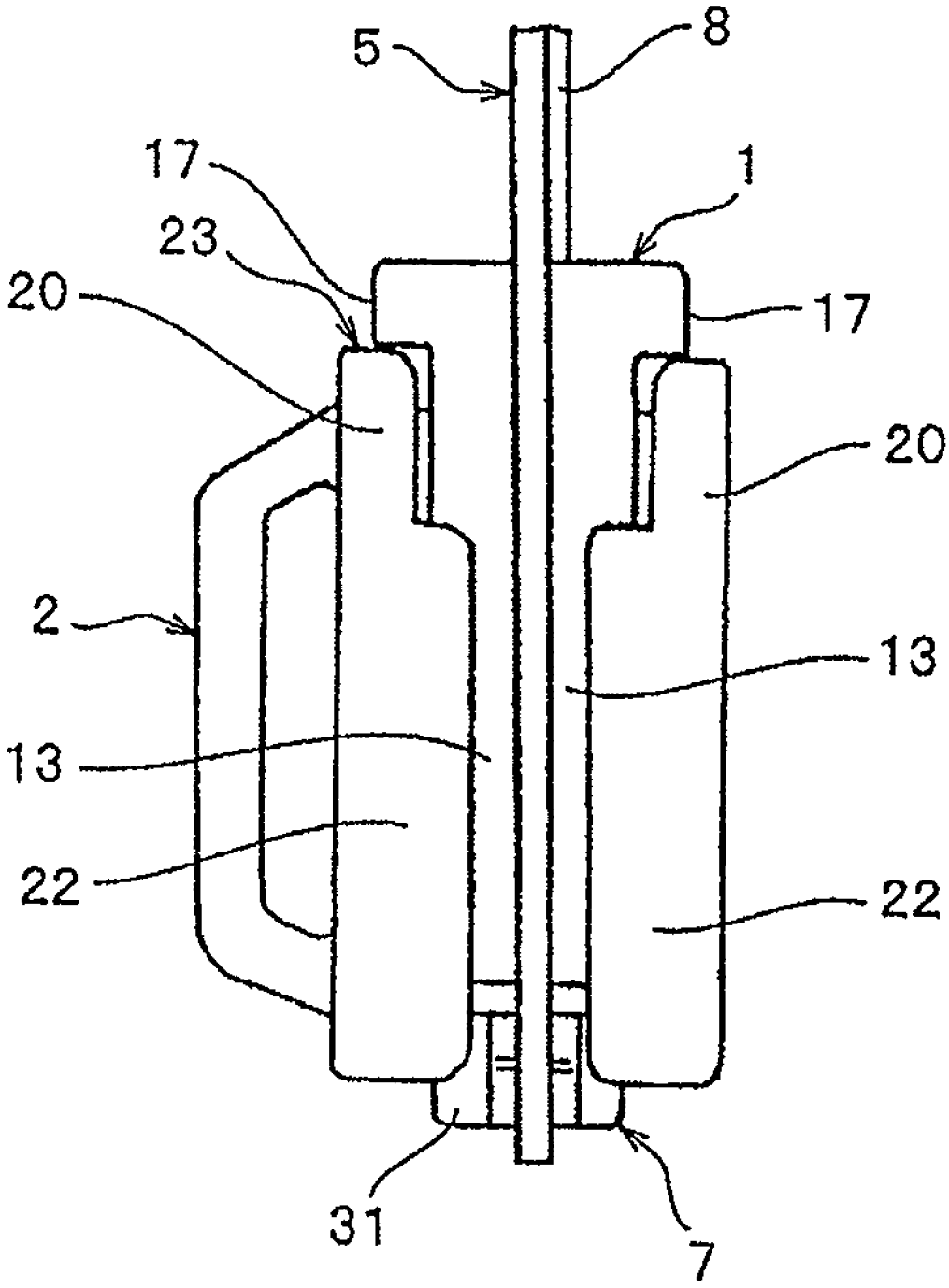
FIG. 9 is a side view showing a state in which a slider is brought into a sliding contact with the top end stop.

Stoppers 17 are projected from the front and rear surfaces as shown in FIG. 9 at the closed front end of the top end stop 1 such that the stoppers 17 meet outer edges of shoulder mouths of head portions 23 of the upper and lower blades 20 of the slider 2 and can make contact therewith, as shown in FIG. 2. Consequently, the head portions 23 of the blades 20 of the slider 2 are brought into an aggressive contact with the stoppers 17 to stop the sliding of the slider 2. The base fabrics 4 outside the stoppers 17 are lined with a seal material 8 made of thermoplastic elastomer in order to secure waterproof property.

A use condition of this top end stop 1 will be described hereinafter. When the slider 2 mounted on the right and left base fabrics 4 is slid toward the top end stop 1 as shown in FIG. 5, the diamond 21 pushes and opens the passage portions 14 of the top end stop 1 having elasticity, and the head portions 23 of the blades 20 of the slider 2 make contact with the stoppers 17 while the diamond 21 is accommodated in the accommodating portion 10. Consequently, the flanges 22 of the slider 2 push the right and left pressing portions 15 to bring the passage portions 14 into a pressure contact with each other. In addition, the protrusions 12 of the top end stop 1 make a pressure contact with the inner faces of the blades 20 of the slider 2, thereby maintaining waterproof and airproof properties at terminals of the base fabrics 4.

To release the waterproof and airproof properties, the slider 2 is slid in a direction of departing from the top end stop 1 to push apart the passage portions 14 of the insertion leg portions 13 by means of the diamond 21, thereby allowing the slider 2 to slide.

Figure 7:
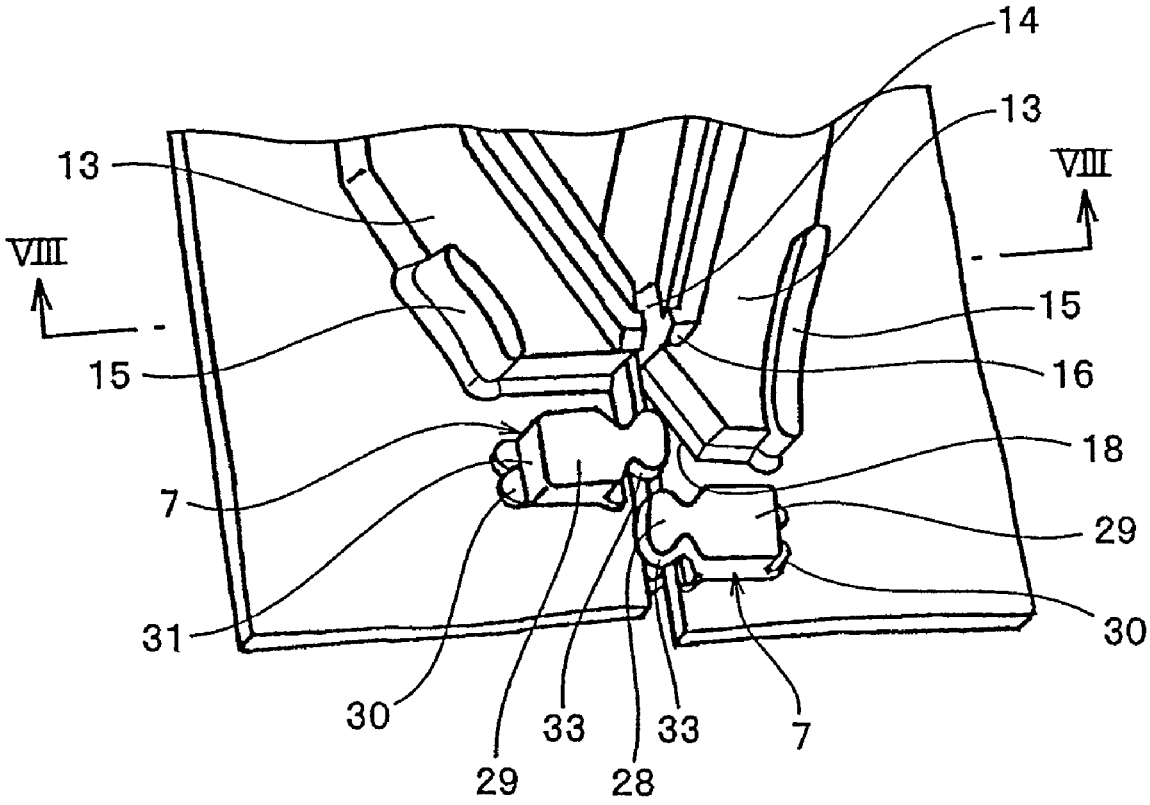
FIG. 7 is a perspective view of a modification of the top end stop.
Figure 8:
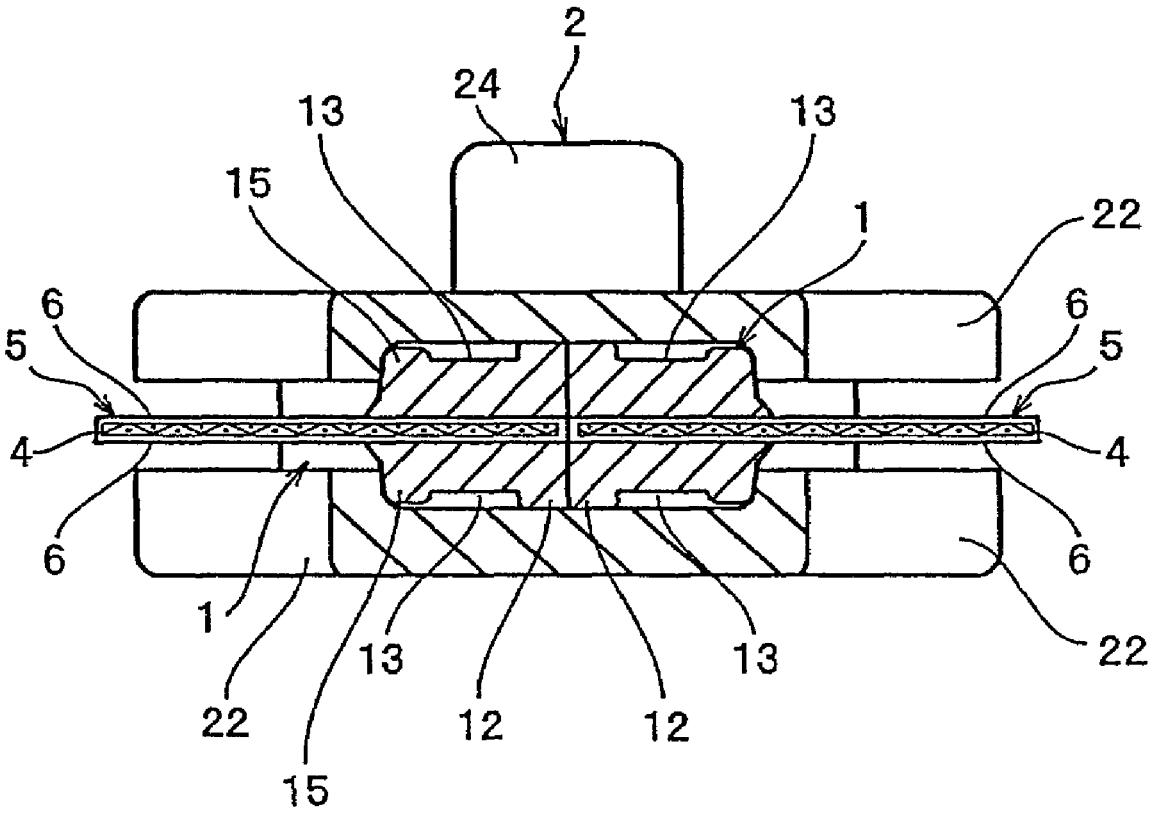
FIG. 8 is a sectional view of the modification of the top end stop taken along a line VIII-VIII in FIG. 7.

FIGS. 7 and 8 show a modification of the waterproof top end stop according to the first embodiment. In a peripheral portion of the top end stop 1, inclined portions are formed at least at the pressing portions 15 and the insertion leg portions 13 on a side of the fastener elements 7 of the fastener tapes 5. As shown in a cross sectional view in FIG. 8, the inclined portions are formed in a inclined plane shape in which thickness thereof is reduced toward an outside of the top end stop 1. With this feature, the top end stop 1 is not easily caught even if someone intentionally tries to peel it off, thereby enabling to provide the top end stop 1 enduring a long-term use.

Second Embodiment

Figure 10:
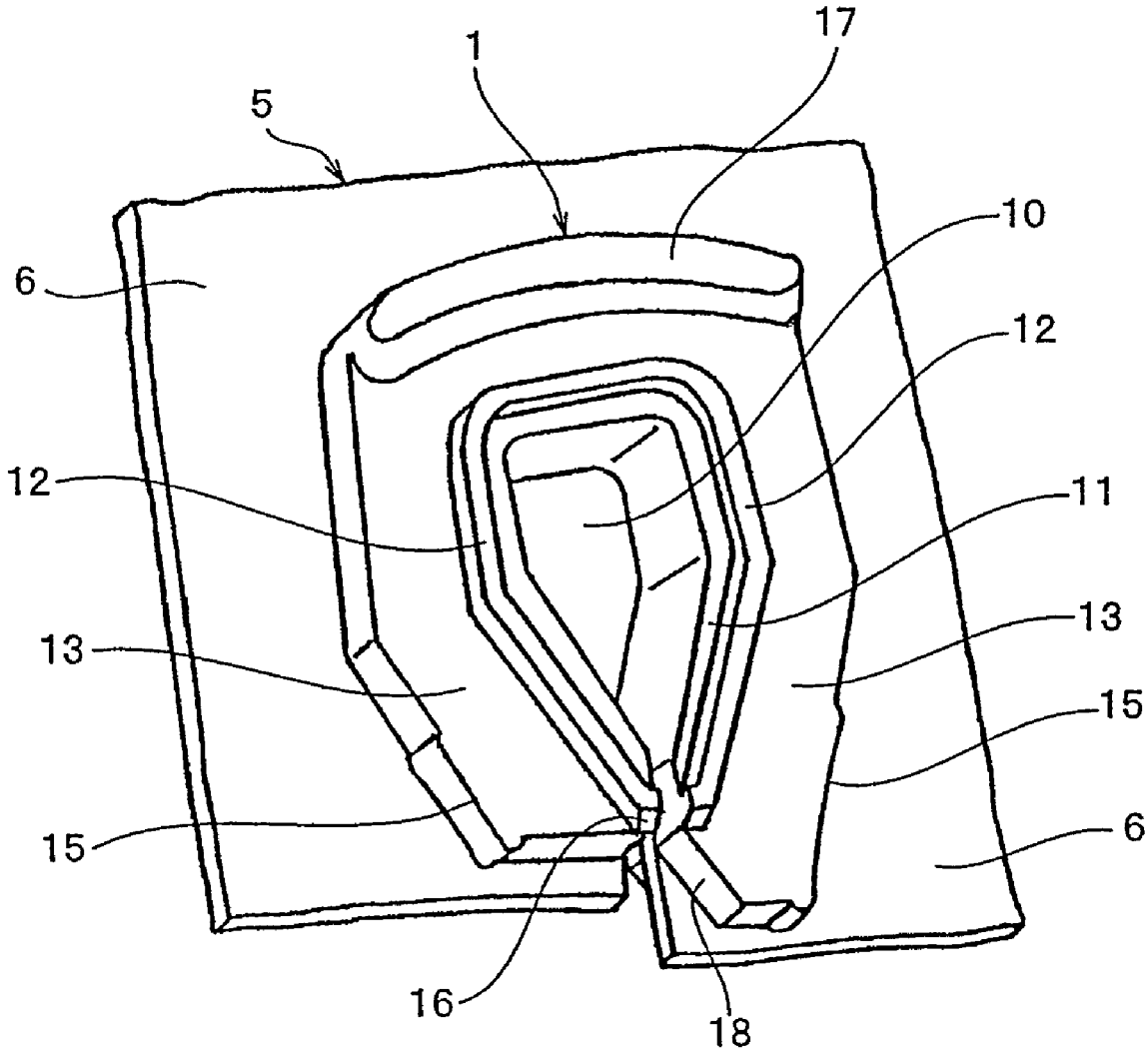
FIG. 10 is a perspective view of another top end stop.
Figure 11:
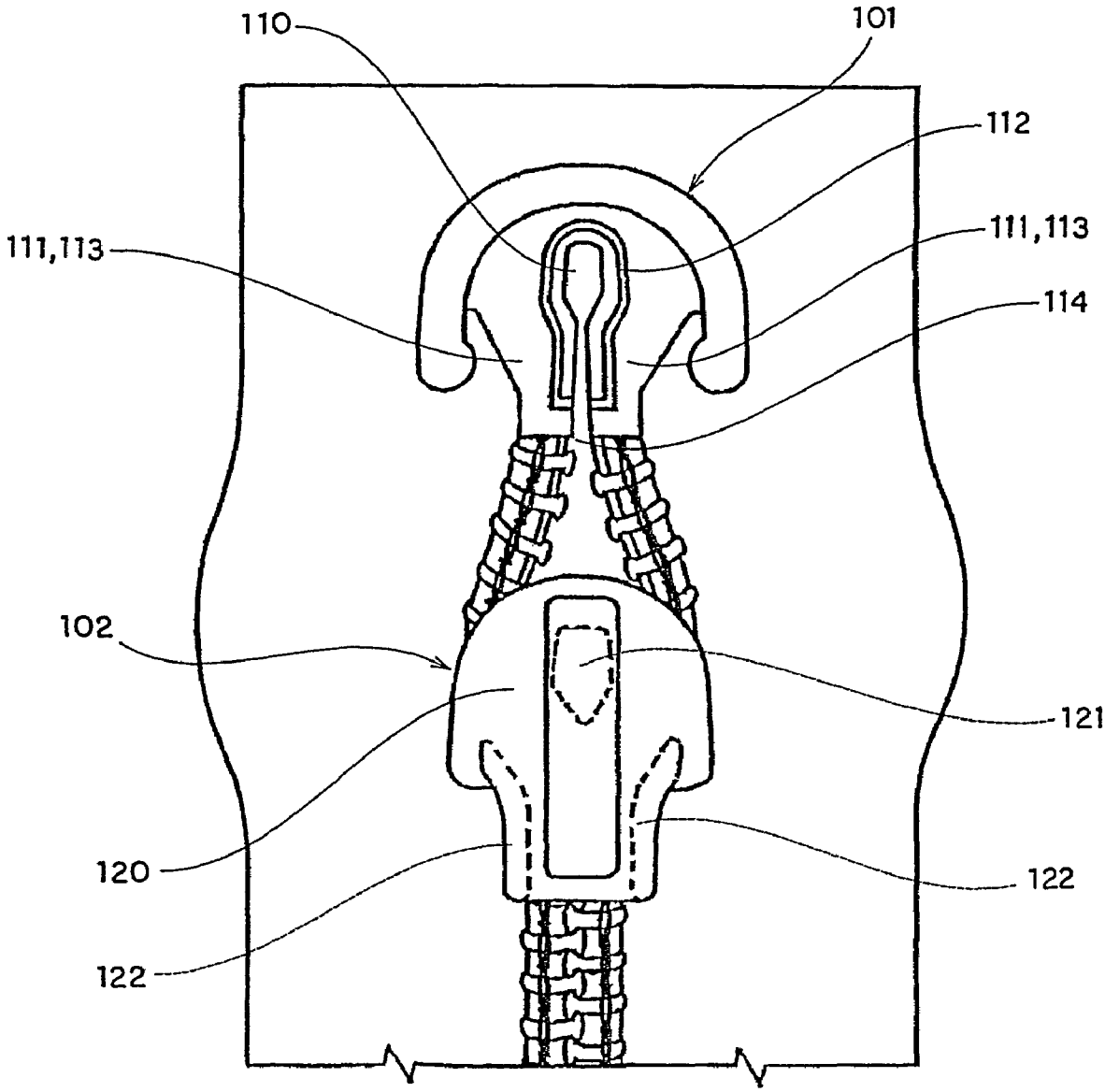
FIG. 11 PRIOR ART
FIG. 11 is a front view showing a use condition of a known top end stop.

A waterproof top end stop according to a second embodiment shown in FIG. 10 is different from the first embodiment in that a pressing portions 15 provided on outer edges of insertion leg portions 13 of the top end stop 1 are flat and not projected upward/downward. If speaking in detail, the top end stop 1 formed of thermoplastic elastomer has an accommodating portion 10 for accommodating a diamond 21, and protrusions 12 projecting upward/downward along an inner peripheral edge portion 11 of the accommodating portion 10 are provided on front and rear faces so that they can make a pressure contact with inner faces of blades 20. Then, the pressing portions 15 are formed on the outer edges of the right and left insertion leg portions 13 such that they are swollen slightly from outer faces of the insertion leg portions 13. The pressing portions 15 are formed in a same thickness as the insertion leg portions 13 existing on the front and rear faces of the top end stop 1, and makes a sliding contact with inner faces of flanges 22 of the slider 2.

When the slider 2 is slid toward the top end stop 1, the pressing portions 15 formed on the outer edges of the insertion leg portions 13 of the top end stop 1 are pressed by the flanges 22 of the slider 2, so that the insertion leg portions 13 are pushed inward to bring passage portions 14 into a pressure contact with each other. In this top end stop 1, the protrusions 12 provided along the inner peripheral portion 11 of the accommodating portion 10 make a pressure contact with the inner faces of the blades 20 of the slider 2, and the passage portions 14 are brought into a firm contact with each other by the flanges 22 of the slider 2. Consequently, the top end stop 1 has a waterproof function.

The top end stops of the first and second embodiments described above are not restricted to an injection type fastener element but may be applied to a fastener chain having a coil-like fastener element or a zigzag-like fastener element formed of synthetic resin mono-filament. In such a case, contact faces of each leg portion of each fastener element refers to an inverted portion on an opposite side to a coupling head continuous from upper and lower leg portions of the coil-like or zigzag-like fastener element, namely, an outside of a connecting portion, meaning a portion which makes contact with flanges of a sliding slider.

The waterproof top end stop for a slide fastener of the present invention is used in an opening portion of a variety of wet suits and waterproof trousers and an opening portion of waterproof shoe for underwater operation, located under water when used, and in an opening portion of a bag, ensuring waterproof and airproof properties.

What is claimed is:

1. A waterproof top end stop for a slide fastener having elasticity, which is disposed adjacent to fastener elements provided along opposing side edges of a pair of fastener tapes to connect the fastener tapes, comprising:

an accommodating portion for accommodating a diamond of a slider and surrounded by insertion leg portions, the accommodating portion being provided in a center of the top end stop;

protrusions which make contact with upper and lower blades of the slider, the protrusions being provided along an inner peripheral edge portion of the accommodating portion; and pressing portions which are projected outwardly from side edges of the top end stop, each side edge of the top end stop being on an opposite side of the top end stop from the opposing side edges of the fastener tapes, and the pressing portions projecting outwardly with respect to contact faces of leg portions in the fastener elements adjacent to both outer sides of the top end stop, the pressing portions being provided at the ends of the insertion leg portions only on part of right and left outer edge portions of the insertion leg portions along a length direction of the fastener tapes, wherein passage portions are constructed so as to be closed firmly due to contact between the pressing portion and the slider.

2. The waterproof top end stop for a slide fastener according to claim 1, wherein the pressing portions are disposed at least on outer edge portions of the insertion leg portions corresponding to the passage portions.

3. The waterproof top end stop for a slide fastener according to claim 2, wherein the pressing portions are provided on the outer edge portions on a side of an entrance of the insertion leg portions, and the outer edge portions of the insertion leg portions adjacent to the pressing portions and on an opposite side to the fastener elements relative to the pressing portions are formed narrower than an interval between flanges of the slider such that the outer edge portions do not make contact with the flanges.

4. The waterproof top end stop for a slide fastener according to claim 1, wherein the pressing portions are formed to project in up and down directions from the insertion leg portions.

5. The waterproof top end stop for a slide fastener according to claim 4, wherein the insertion leg portions are formed to be recessed between the protrusions and the pressing portions, the protrusions and the pressing portions projecting in up and down direction.

* * * * *